US005575588A

United States Patent [19]

Nakamura

[11] Patent Number: 5,575,588

[45] Date of Patent: Nov. 19, 1996

[54] METHOD OF CONSTRUCTING A SLOPE PROTECTON

[75] Inventor: Yukichi Nakamura, Tokyo, Japan

[73] Assignee: Okanishi Trading Co., Ltd., Tokyo, Japan

[21] Appl. No.: 414,107

[22] Filed: Mar. 31, 1995

[30] Foreign Application Priority Data

Aug. 5, 1994 [JP] Japan ..... 6-183302

[51] Int. Cl.[6] ..... E02B 3/12

[52] U.S. Cl. ..... 405/18; 405/15; 405/258

[58] Field of Search ..... 405/15, 16, 18, 405/36, 258, 268, 270

[56] References Cited

U.S. PATENT DOCUMENTS

| | | | |
|---|---|---|---|
| 984,121 | 2/1911 | Condie | 405/18 |
| 3,425,228 | 2/1969 | Lamberton | 405/18 |
| 4,102,137 | 7/1978 | Porraz et al. | 405/18 |
| 4,135,843 | 1/1979 | Umemoto et al. | 405/18 |
| 4,518,280 | 5/1985 | Fletcher | 405/15 X |
| 5,108,222 | 4/1992 | Jansson et al. | 405/15 X |
| 5,310,288 | 5/1994 | Huang | 405/36 X |

*Primary Examiner*—Roger J. Schoeppel
*Attorney, Agent, or Firm*—Knobbe, Martens, Olson & Bear

[57] ABSTRACT

A bag-like mat having discrete slits sealed at their peripheral edges is placed flatly over the soil of a slope to be protected. Then, a concrete is placed in the bag-like mat to expand the latter whereupon the slits are spread so as to form openings which is subsequently used for planting seedings or saplings through the openings to vegetate the slope. A slope protection can, therefore, be constructed efficiently at a low cost. By properly selecting the shape, size and arrangement of the slits, the slope protection may have a desired design pattern.

7 Claims, 5 Drawing Sheets

METHOD OF CONSTRUCTING A SLOPE PROTECTON

BACKGROUND OF THE INVENTION

1. Field of the Invention

The present invention relates to a method of constructing a slope protection by placing a bag-like mat over the soil of a slope, followed by placing a concrete or a soil into the bag-like mat, followed by vegetation and subsequent greening of the slope.

2. Description of the Prior Art

A conventional bag-like fabric mat which is filled with a concrete, a soil or the like to construct a slope protection is shown here in FIGS. 5(*a*) and 5(*b*) of the accompanying drawings. The mat 1 is made of synthetic fiber such as nylon and includes a two-ply or double-layered portion 2 having an internal space defined between front and back layers of the mat for receiving therein the concrete, for example, and a single-ply or single-layered portion 3 free of the internal space. The conventional mat thus constructed has a problem that the single-layered portion 3 can exist for a long period of time without deterioration and hence prevents vegetation and subsequent greening of the slope. To deal with this problem, the single-layered portion 3 is cut out or removed after the concrete is placed in the mat, as shown in FIG. 5(*c*). Now, vegetation and subsequent greening of the slope is possible. However, this method still has a drawback that it is time-consuming because a cutting work due for removing a portion of the bag-like mat should be achieved in a process of construction of the slope protection. Another drawback is that the bag-like mat is comparatively expensive because an effectively usable portion of the fabric is relatively small.

SUMMARY OF THE INVENTION

With the foregoing drawbacks of the prior art in view, it is a general object of the present invention to provide a method which is capable of constructing a slope protection efficiently at a low cost.

A more specific object of the present invention is to provide a slope-protection constructing method which is capable of forming openings in a bag-like mat available for vegetation and subsequent greening of the slope at the same time the mat is filled with a filling material such as a concrete.

Another object of the present invention is to provide a slope-protection constructing method including a bag-like mat which is free of cutout portions and hence can be utilized at substantially one-hundred percent efficiency and is comparatively inexpensive.

According to the present invention, there is provided a method of constructing a slope protection, which method comprises the steps of: (a) providing a bag-like mat composed of front and back fabric layers joined together to define therebetween an internal space in which a filling material includes a concrete, a soil or the like can be placed, the mat having a plurality of discrete slits extending across the thickness of the front and back fabric layers, the mat being closed along a portion extending around each of the slits to form a closed peripheral edge of each slit; (b) placing the bag-like mat flatly over a slope to be protected such that an original plane size of the bag-like mat is substantially maintained; (c) subsequently placing the filling material in the internal space of the bag-like mat to expand the bag-like mat, thereby causing the slits to spread out to form openings; and (d) finally vegetating the slope through the openings.

The slits are preferably straight and composed of a plurality of rows of parallel spaced slits. The slits extend in a horizontal direction when the bag-like mat is placed over the slope. In one preferred form of the invention, the rows of parallel spaced slits are arranged in staggered relation to one another. In another preferred form of the invention, the rows of parallel spaced slits are laterally aligned with one another. The slits may be composed of a plurality of first diagonal slits and a plurality of second diagonal slits extending at right angles to the first slits and disposed alternatively with the first slits. It is preferably that the first and second diagonal slits are each arranged in a knight-jump pattern of the chess in one direction of the bag-like mat.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 1(*b*) is a view similar to FIG. 1(*a*), but shown the bag-like mat filled with the concrete;

FIG. 2(*c*) is a cross-sectional view taken along line C—C of FIG. 1(*b*);

FIG. 3(*a*) is a fragmentary plan view of a bag-like mat shown in a condition before it is filled with a concrete according to a second embodiment of the present invention;

FIG. 3(*b*) is a view similar to FIG. 3(*a*), but showing the bag-like mat filled with the concrete;

FIG. 4(*b*) is a view similar to FIG. 4(*a*), but showing the bag-like mat filled with the concrete;

FIG. 5(*b* ) is a cross-sectional view of FIG. 5(*a*); and

FIG. 5(*c*) is a view similar to FIG. 5(*b*), but showing the bag-like mat with a single-layered portion removed.

DETAILED DESCRIPTION OF THE INVENTION

Certain preferred embodiments of the present invention will be described below in greater detail with reference to the accompanying drawings.

Figure 1A:
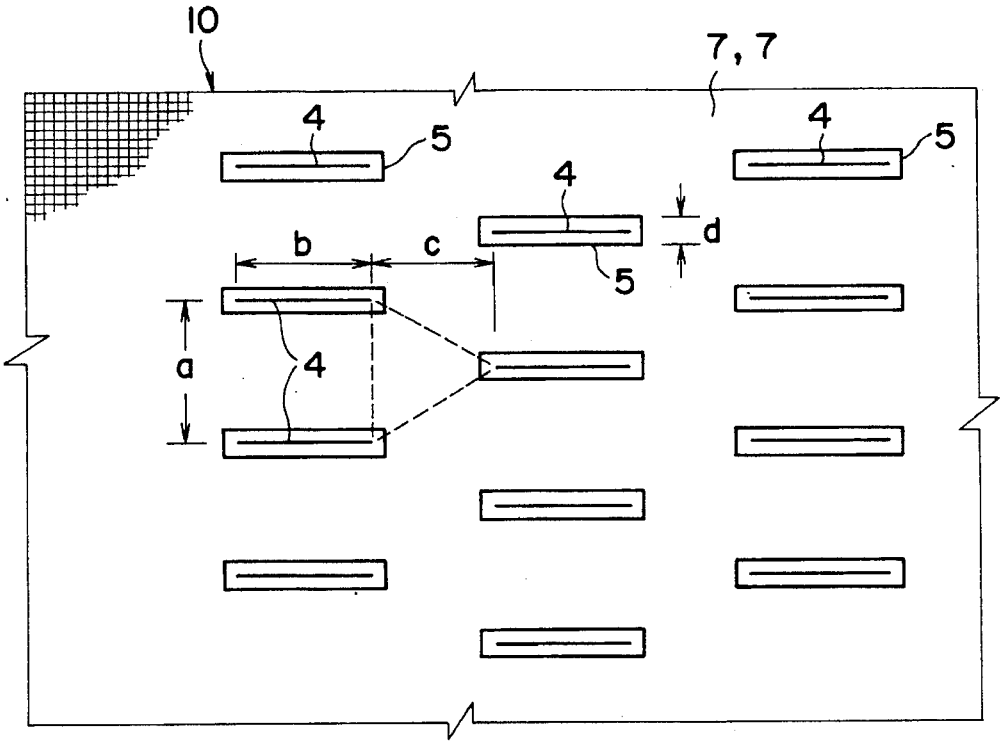
FIG. 1(*a*) is a fragmentary plan view of a bag-like mat shown in a condition before it is filled with a concrete according to a first embodiment of the present invention.
Figure 1B:
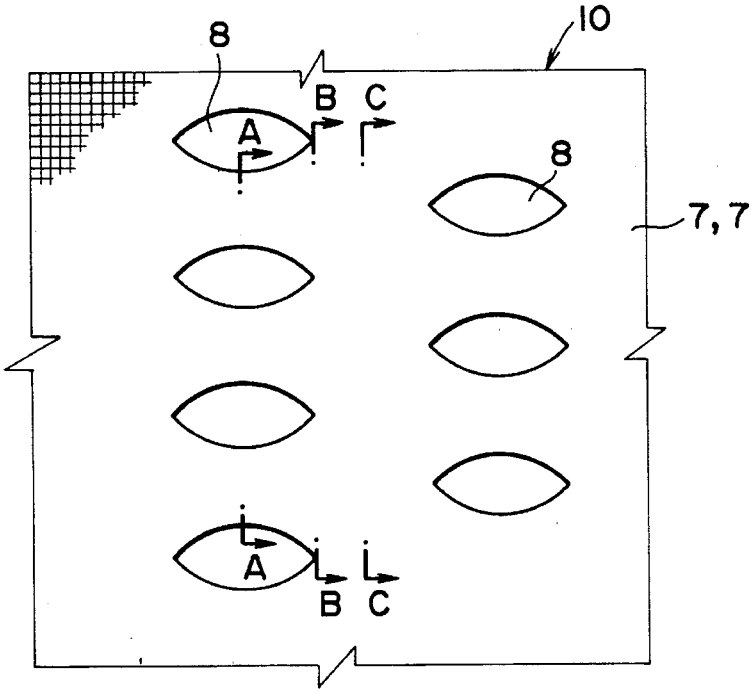

Referring now to FIG. 1(*a*), there is shown a bag-like mat 10 according to a first embodiment of the present invention. The mat 10 is composed of a double-layered woven cloth or fabric including front and back layers 7, 7 that are sewn together along their peripheral edges so as to define therebetween an internal space in which a suitable filling material such as a concrete, a soil and the like can be filled or placed. The bag-like mat 10 has a plurality of rows of parallel spaced straight slits 4 each formed by outting a corresponding portion of the mat 10 across the thickness of the front and back layers 7, 7. The front and back layers 7, 7 are also sewn together along a portion extending around each of the slits 4 so as to form a closed peripheral edge portion 5 of the slit 4. As an alternative, the bag-like mat 10 may be fabricated such that is has a plurality of spaced single-layered portions (not shown) arranged in a predetermined pattern so as to provide concealed or closed portions where the aforesaid straight slits 4 are to be formed.

In the illustrated embodiment, the rows of slits 4 are parallel to one another and arranged in zigzag or staggered relation. More specifically, as shown in FIG. 1(*a*), the slits 4 are arranged under the conditions that the distance or pitch "a" between two adjacent slits 4 in each row of slits 4 is 300 mm, the length "b" of the slits is 300 mm, and minimum transverse distance "c" between two adjacent ones of the laterally spaced rows of slits 4 is 250 mm, and the width "d" of the closed portions 5 is 30 mm.

The thus fabricated bag-like mat 10 is placed flatly over the soil of a slope to be protected in such a manner that the original plane size of the mat 10 is substantially maintained and the slits 4 extend in a horizontal direction. Then, a suitable filling material such as a concrete is placed from a top edge of the bag-like mat 10 into the internal space of the bag-like mat 10 until the bag-like mat 10 is filled with the concrete. When the bag-like mat 10 is filled with the concrete 6, it slightly contracts in both longitudinal and transverse directions, and at the same time, the internal space between the front and back fabric layers 7, 7 are expanded. With this expansion of the internal space, the confronting edges of each slit 4 are deformed or bent arcuately and outwardly. The slit 4 is thus spread out, thereby forming a generally almond-shaped opening 8, as shown in FIG. 1(*b*).

Figure 2A:
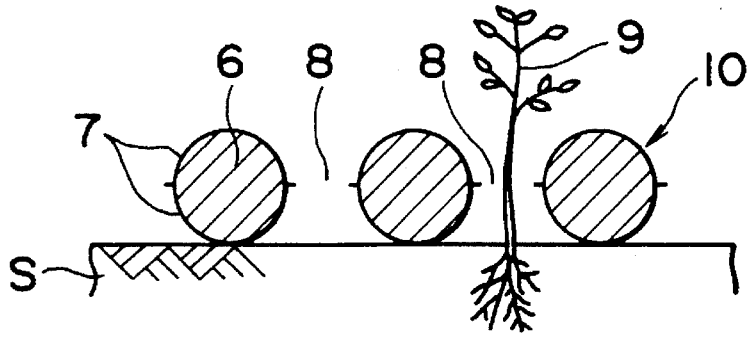
FIG. 2(*a*) is a cross-sectional view taken along line A—A of FIG. 1(*b*)
Figure 2B:
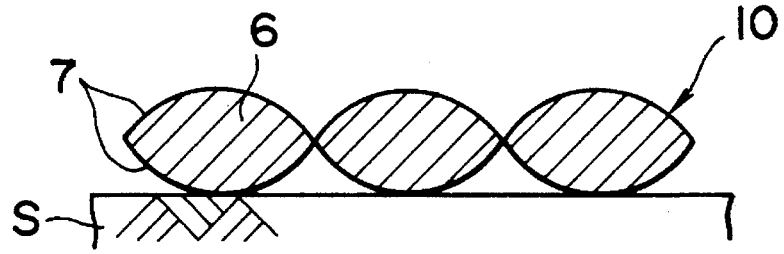
Figure 2C:
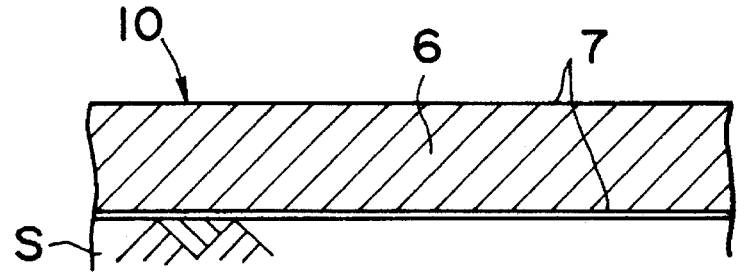

In other words, when the bag-like mat 10 is filled with the concrete 6, a portion of the bag-like mag 10 which is disposed centrally between each pair of adjacent slits 4 is expanded such that the front and back fabric layers 7, 7 are expanded outwardly and arcuately and jointly form an internal space portion having a circular cross section, as shown in FIG. 2(*a*). In this instance, the almond-shaped openings 8 each located between two adjacent ones of such expanded portions has a maximum width of about 100 mm.

At a portion of the bag-like mat 10 which is disposed between respective one ends of two adjacent slits 4, the front and back fabric layers 7, 7 are expanded outwardly and arcuately to a smaller extend than attained at the portion described above. The arcuately expanded front and back fabric layers 7, 7 jointly form an internal space portion having a generally almond-shaped cross section, as shown in FIG. 2(*b*). Similarly, at a portion of the bag-like mat 10 which extends between two adjacent ones of the laterally spaced rows of slits 4, the front and back fabric layers 7, 7 are parallel spaced apart, as shown in FIG. 2(*c*).

The openings 8, which are formed at the same time the concrete 6 is placed in the bag-like mat 10, are subsequently used for vegetating the slope S. The vegetation is generally achieved by planting seedings or saplings 9 through the openings 8, as shown in FIG. 2(*a*). A slope protection is thus constructed. When necessary, it is also possible to add earth through the openings 8 over the seedings or saplings 9, or fertilize the soil through the openings 8, thereby promoting the growth of the seedings or saplings 9. In the case where the virgin soil of the slope S to be protected contains many seedings or grabs, the slope may vegetate naturally without requiring a particular vegetation work such as planting.

In the embodiment described above, the dimensions "a", "b" and "c" of the slits 4 arranged in zigzag or staggered relation are determined such that neighboring ends of three adjacent ones of the slits 4 are located on apexes of an equilateral or regular triangle, respectively, as shown in FIG. 1(*a*). This arrangement is particularly advantageous in that the finished slope protection is extremely stable because the maximum height or thickness of the expanded mat 10 is substantially uniform over the entire area of the mat 10, as understood from FIGS. 2(*a*)–2(*c*).

The dimensions "a", "b", "c" and "d" of the slits 4 specified above should be construed as illustrative and not restrictive. For the slits 4 arranged zigzag, other combinations of the dimensions "a"–"d" are possible according to the present invention, such as shown in Table 1.

TABLE 1

| | Dimensions | | | |
|---|---|---|---|---|
| Model | "a" | "b" | "c" | "d" |
| A-200 | 200 | 200 | 100 | 30 |
| | | 300 | 150 | |
| | | 400 | 200 | |
| A-300 | 300 | 300 | 150 | 30 |
| | | 450 | 225 | |
| | | 600 | 300 | |
| A-200 | 400 | 400 | 200 | 30 |
| | | 600 | 300 | |
| | | 800 | 400 | |

Figure 3A:
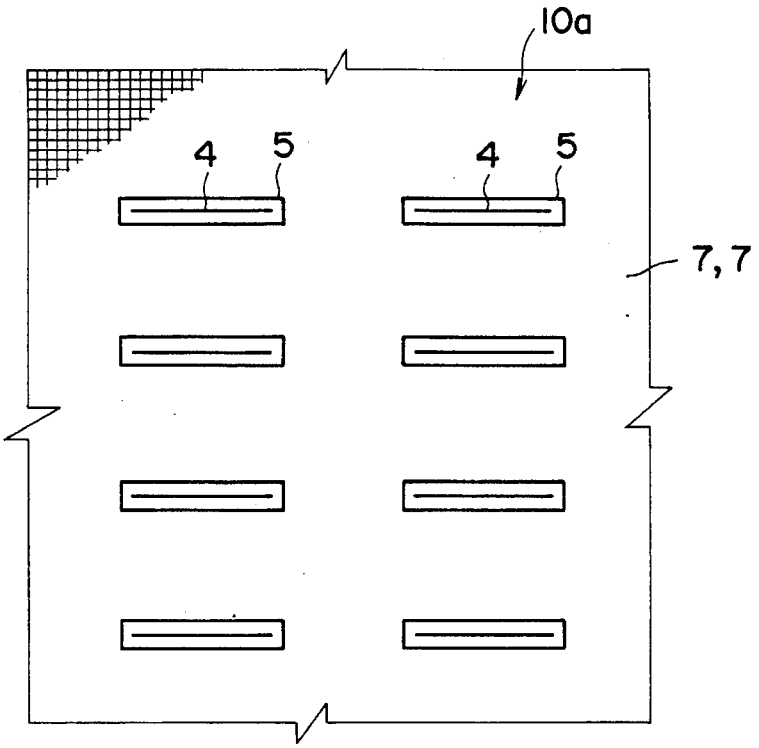
FIG. 3(*b*) is a cross-sectional view taken along line B—B of FIG. 1(*b*)
Figure 3B:
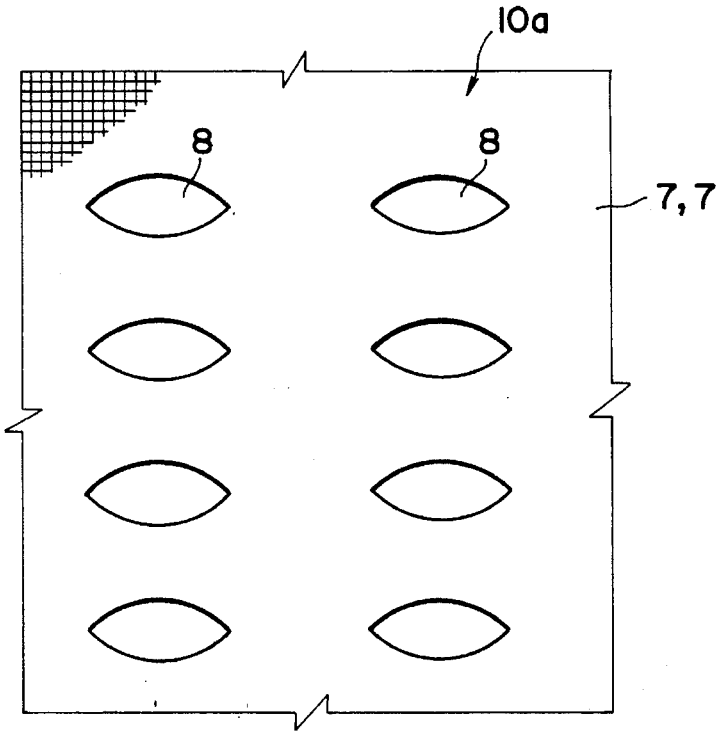

FIG. 3(*a*) illustrates a bag-like mat 10*a* according to a second embodiment of the present invention. The illustrated mat 10*a* differs from the mat 10 of the first embodiment of FIG. 1(*a*) in that a plurality of rows of parallel spaced straight slits 4 are laterally aligned.

Figure 4A:
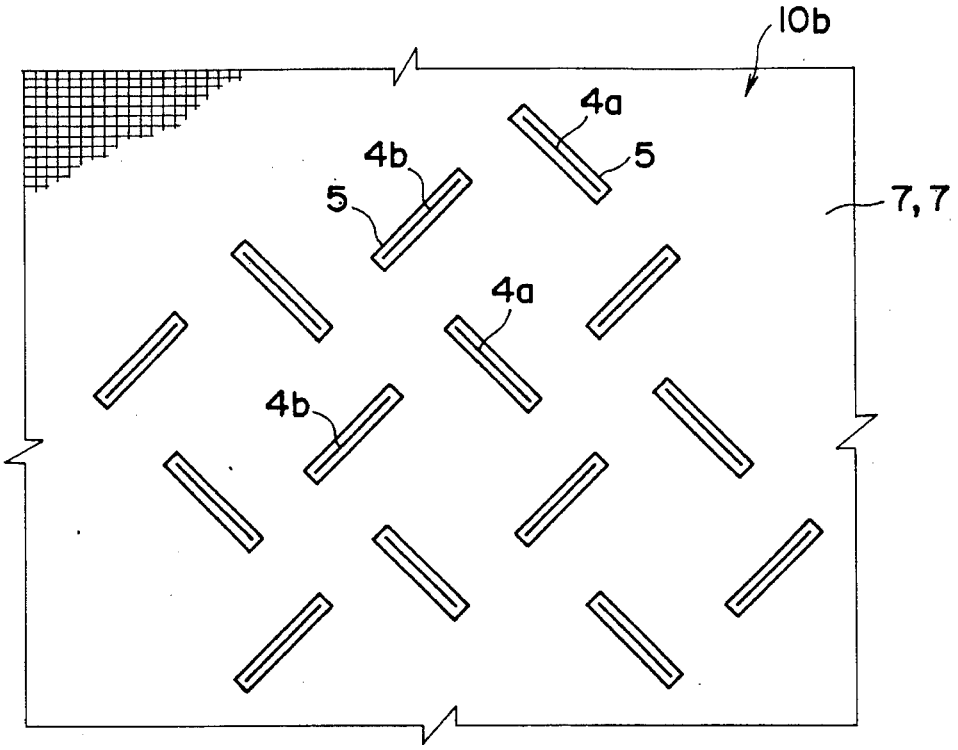
FIG. 4(*a*) is a fragmentary plan view of a bag-like mat shown in a condition before it is filled with a concrete according to a third embodiment of the present invention.
Figure 4B:
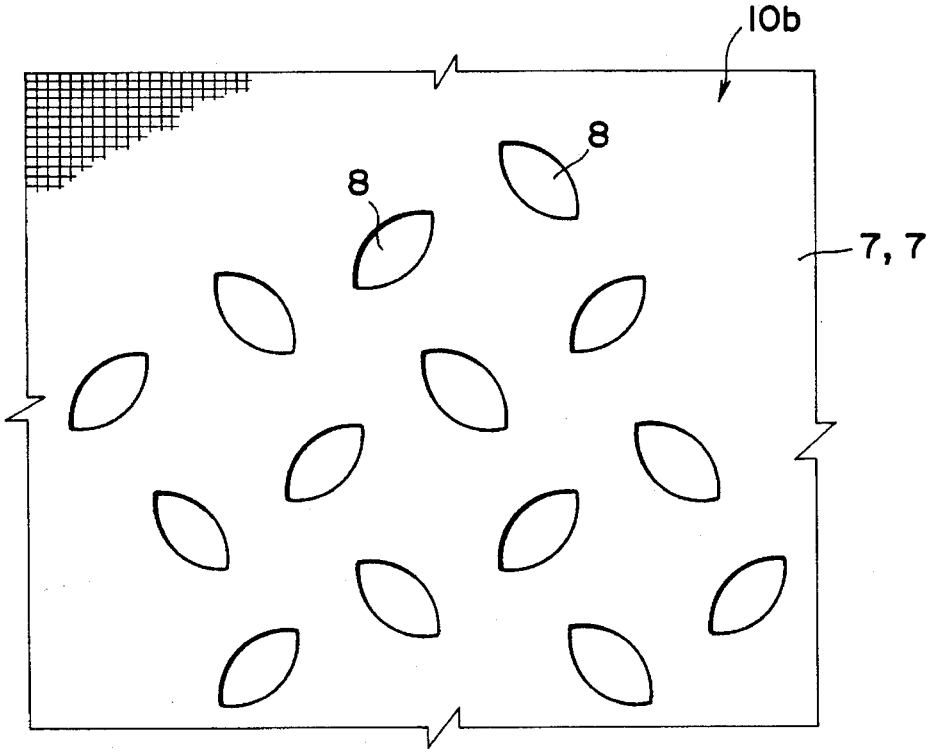
Figure 5A:
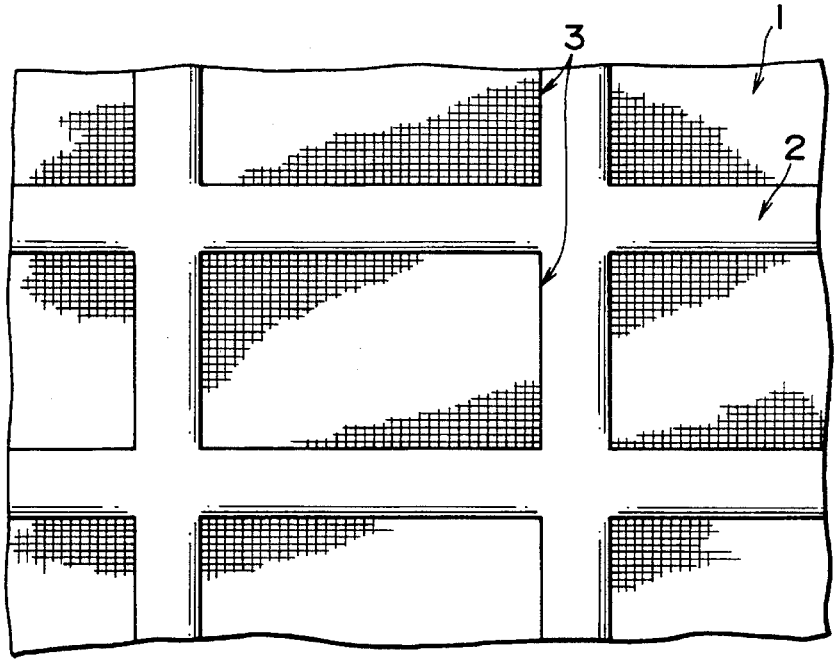
FIG. 5(a) PRIOR ART
FIG. 5(*a*) is a fragmentary plan view of a conventional bag-like mat.
Figure 5B:
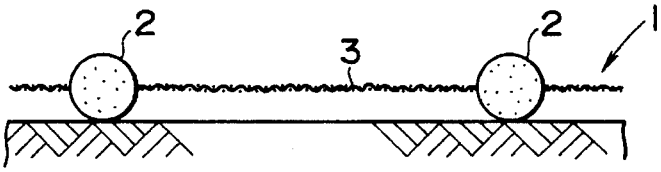
FIG. 5(b) PRIOR ART
Figure 5C:
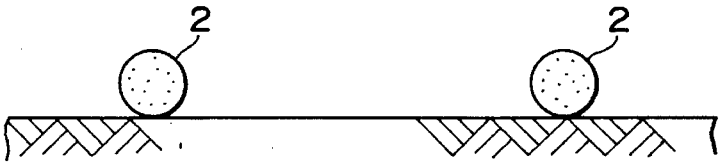
FIG. 5(c) PRIOR ART

FIG. 4(*a*) shows a modified bag-like mat 10*b* according to a third embodiment of the present invention. The mat 10*b* has a plurality of first straight slits 4*a* extending in a diagonal direction of the mat 10*b* arranged in a knight-jump pattern of the chess in one or the vertical direction of the mat 10*b*, and a plurality of second straight slits 4*b* extending diagonally of the mat 10*b* at right angles to the first straight slits 4*a* so as to assume a knight-jump pattern of the chess in the other or horizontal direction of the mat 10.

Likewise the mat 10 in the first embodiment described above, each of the mats 10*a* and 10*b* shown in FIGS. 3(*a*) and 4(*a*), respectively, is placed flatly over a slope to be protected, followed by placing a concrete in an internal space defined between front and back fabric layers 7, 7 of the mat 10*a*, 10*b*. The mat 10*a*, 10*b*, as it is filled with the concrete, expands, thus causing the slits 4; 4*a* and 4*b* to spread out to eventually form generally almond-shaped openings 8, as shown in FIGS. 3(*b*) and 4(*b*). Subsequently, seedings or saplings 9 are planted through the openings 8 to vegetate the slope, thus completing construction of a slope protection.

In general, the slits 4 are straight and have a length in the range of from 200 mm to 800 mm. It is to be noted however that the form of the slits 4 is not restricted to the straight form such as shown in the illustrated embodiments. Rather, the length, arrangement and form of the slits may be combined in various ways so as to provide openings having a desired shape and configuration and arranged in a desired pattern that the particularly useful for vegetation and subsequent greening of the slope.

As described above, a bag-like mat of this invention has a plurality of discrete slits and is closed along a portion extending around each of the slits to form a peripheral edge of the slit. When the bag-like mat while being placed flatly over a slope to be protected is filled with a filling material such a concrete, the slits are automatically spread out to form openings which can readily be used for the vegetation of the slope which may be achieved by planting seedings or saplings through the openings. With the use of the bag-like mat, a slope protection can be constructed efficiently and the thus constructed slope protection is effective to promote vegetation and subsequent greening of the slope.

The bag-like mat is simple in construction and easy to manufacture. Furthermore, the mat is comparatively inexpensive because the fabric used to fabricate the mat can be used at substantially one-hundred percent efficiency.

Be properly selecting the shape, size and arrangement of the slits, a finished slope protection may have a design pattern capable of meeting an esthetic demand.

It is apparent from the foregoing description that the present invention provides a method which is capable of constructing a slope protection efficiently and inexpensively while providing an attractive design pattern on a surface of the slope protection.

Obviously, various minor changes and modifications of the present invention are possible in the light of the above teaching. It is therefore to be understood that within the scope of the appended claims the invention may be practiced otherwise than as specifically described.

What is claimed is:

1. A method of constructing a slope protection, comprising the steps of:

(a) providing a bag-like mat composed of front and back fabric layers joined together to define therebetween an internal space in which a filling material including a concrete, a soil or the like can be placed, said mat having a plurality of discrete slits extending across the thickness of said front and back fabric layers, said mat being closed along a portion extending around each of said slits to form a closed peripheral edge of each said slit, said closed peripheral edge being formed along a shape of said slit and in close proximity to said slit;

(b) placing a said bag-like mat flatly over a slope to be protected such that an original plane size of said bag-like mat is substantially maintained;

(c) subsequently placing said filling material in said internal space of said bag-like mat to expand said bag-like mat, thereby causing said slits to spread out to form openings through said front and back fabric layers; and (d) finally vegetating the slope through said openings.

2. A method according to claim 1, wherein said slits are straight.

3. A method according to claim 1, wherein said slits are composed of a plurality of rows of parallel spaced slits, and said slits extend in a horizontal direction when said bag-like mat is placed over the slope.

4. A method according to claim 3, wherein said rows of parallel spaced slits are arranged in staggered relation to one another.

5. A method according to claim 3, wherein said rows of parallel spaced slits are laterally aligned with one another.

6. A method according to claim 1, wherein said slits are composed of a plurality of first diagonal slits and a plurality of second diagonal slits extending at right angles to said first slits and disposed alternately with said first slits.

7. A method according to claim 6, wherein said first and second diagonal slits are each arranged in a knight-jump pattern of the chess in one direction of said bag-like mat.

* * * * *